US006663551B2

(12) United States Patent
Auerbach et al.

(10) Patent No.: US 6,663,551 B2
(45) Date of Patent: Dec. 16, 2003

(54) BUCKLE CHUTE FOLDING MACHINE WITH A DEFLECTOR CONTROL MECHANISM

(75) Inventors: David R. Auerbach, West Redding, CT (US); William J. Wright, Killingworth, CT (US)

(73) Assignee: Pitney Bowes Inc., Stamford, CT (US)

( * ) Notice: Subject to any disclaimer, the term of this patent is extended or adjusted under 35 U.S.C. 154(b) by 8 days.

(21) Appl. No.: 10/029,776

(22) Filed: Oct. 26, 2001

(65) Prior Publication Data

US 2003/0083183 A1 May 1, 2003

(51) Int. Cl.[7] ..... B31F 1/00

(52) U.S. Cl. ..... 493/420; 271/16; 271/19; 493/416; 493/421; 493/424; 493/442; 493/461; 493/419

(58) Field of Search ..... 493/419, 420, 493/416, 421, 424, 442, 460, 461; 271/16, 19

(56) References Cited

U.S. PATENT DOCUMENTS 3,975,009 A * 8/1976 Brown ..... 493/14
4,699,367 A * 10/1987 Russel ..... 271/65
5,020,784 A * 6/1991 Asami et al. ..... 270/58.11
5,090,671 A * 2/1992 Gombault et al. ..... 270/45
5,180,357 A 1/1993 Marzullo
5,263,708 A * 11/1993 Hacknauer ..... 271/303
5,322,498 A 6/1994 Lehmann et al.
5,352,177 A 10/1994 Walter
5,514,066 A * 5/1996 Monaco ..... 493/25
5,520,603 A 5/1996 Bluthardt et al.
5,551,939 A * 9/1996 Deckers ..... 493/442
5,690,325 A * 11/1997 Morimoto ..... 271/65
5,967,963 A 10/1999 Gotting
6,446,958 B1 * 9/2002 Sette et al. ..... 271/225

* cited by examiner

*Primary Examiner*—Eugene Kim
*Assistant Examiner*—Christopher R Harmon
(74) *Attorney, Agent, or Firm*—Michael J. Cummings; Charles R. Malandra, Jr.; Angelo N. Chaclas

(57) ABSTRACT

A buckle chute having a deflector disposed in front thereof to allow a sheet of document to enter the buckle chute channel or to deflect the sheet away from the channel. The deflector is pivotally linked to two actuator arms on the left and right sides of the buckle chute. Each actuator arm is pivotally linked to a bell crank, which is also pivotally linked to a linking member. The linking members are further connected to a lever such that they can be moved in opposite directions from left to right or from right to left so as to cause the bell cranks to rotate in opposite directions. As such, the actuator arms are simultaneously moved toward or away from the front side to control the deflector position.

5 Claims, 13 Drawing Sheets

BUCKLE CHUTE FOLDING MACHINE WITH A DEFLECTOR CONTROL MECHANISM

FIELD OF THE INVENTION

The present invention relates generally to a folding machine for folding one or more sheets of document into a folded piece and, more particularly, to a buckle chute.

BACKGROUND OF THE INVENTION

Folding machines are well known. For example, U.S. Pat. No. 4,701,233 (Beck et al.) discloses a method of folding a sheet by bulging a portion of the sheet and then folding the bulged portion through a roller nip. U.S. Pat. No. 4,875,965 (Marzullo) discloses a folding apparatus wherein a buckle chute is used for stopping a sheet, causing the sheet to enter a roller nip for folding. U.S. Pat. No. 4,944,131 (Gough) also discloses a folding apparatus having a buckle chute. In all folding machines having one or more buckle chutes, the sheet is allowed to enter into a channel of the buckle chute until the leading edge of the sheet is stopped by a stop. The leading edge stays in contact with the stop while the bulged portion is moved toward the roller nip for making a folded edge. If a number of folded edges are to be made on one sheet in a folding machine, it is required that the folding machine to have a number of buckle chutes, each corresponding to a folded edge. However, the number of folded edges can be the same as or smaller than the number of buckle chutes. For example, with a folding machine having three buckle chutes, it is possible to make a folded piece with one, two or three folded edges. When the number of folded edges is smaller than the number of buckle chutes on the folding machine, one or more of the buckle chutes on the folding machine must be blocked so that the sheet is prevented from entering the channel of those blocked buckle chutes. In the past, the buckle chutes to be blocked are removed from the folding machine so that a deflector can be installed in front of the channel of the buckle chute. The blocked buckle chutes are then put back on the folding machine. The installed deflector prevents the sheet from entering the channel of the corresponding buckle chute and directs the deflected sheet to the next buckle chute, if there is any.

Removing buckle chutes from a folding machine and re-installing them not only cause some downtime of the folding machine, but may also affect the alignment of the buckle chutes with other components of the folding machine as well.

Thus, it is advantageous and desirable to provide a buckle chute wherein a deflector can be put in place on a buckle chute when required without the need of taking the buckle chute from the folding machine.

SUMMARY OF THE INVENTION

According to the present invention, a buckle chute has a front side, a back side, a left side and a right side for use in a folding apparatus having a first driving mechanism and a second driving mechanism for folding at least one sheet of paper having first and second lateral edges defining a width into a folded piece of the same width, and the first and the second lateral edges are adjacent the left and right sides of the buckle chute. The buckle chute is disposed between the first driving mechanism and the second driving mechanism.

The buckle chute comprise:

- an upper guide and a lower guide for forming a channel having an entry point on the front side of the buckle chute adjacent the first driving mechanism;
- a deflector mechanism, disposed near the entry point of the channel and operable
  - in a first position for allowing a leading edge of said at least one sheet or the folded piece to enter to the channel while said at least one sheet or the folded piece is driven by the first driving mechanism toward the entry point of the buckle chute, or
  - in a second position for preventing the leading edge of said at least one sheet or the folded piece from entering the channel and further directing the leading edge toward the second driving mechanism; and
  - a stop, disposed in the channel between the front side and the back side, for stopping the leading edge of said at least one sheet or the folded piece entering the channel, when the deflector mechanism is operated in the first position, from advancing further into the channel toward the back side so as to cause said at least one sheet or the folded piece to buckle at a locality thereof outside the entry point of the channel toward the second driving mechanism for forming a folded edge at the buckled locality by the second driving mechanism as the first driving mechanism continues driving said at least one sheet or the folded piece toward the buckle chute, wherein the deflector mechanism comprises:
    - an elongated member having a left end and a right end adjacent to the respective sides of the buckle chute, the left end and the right end each having a mounting section with a mounting point defining a rotational axis of the elongated member, and
    - an extended section extended between the left end and the right end from the mounting section of each end and along the longitudinal axis, and
    - a mounting system, disposed near the entry point of the channel for pivotably mounting the elongated member at the mounting point at each end of the elongated member, allowing the elongated member to rotate about the rotational axis relative to the mounting system such that
      - when the deflector mechanism is operated in the second position, the extended section of the elongated member is caused to move toward the entry point of the channel, thereby blocking the entry point, and
      - when the deflector mechanism is operated in the first position, the extended section of the elongated member is caused to move away from the entry point of the channel, thereby unblocking the entry point.

According to the present invention, the mounting system comprises:

- a left crank and a right crank, each disposed near the respective side of the buckle chute, each crank having a first portion with a first pivot point and a second portion with a second pivot point spaced from the first pivot point; and
- a left mounting member and a right mounting member, each fixedly disposed near the respective side of the buckle chute adjacent to the entry point, for pivotably mounting the respective crank at the second pivot point thereof, allowing the first portion to move toward the front side or the back side of the buckle chute relative to the respective mounting member, and each end of the elongated member is pivotably mounted to the respective crank at the first pivot point such that the elongated member can be caused to rotate about the rotational axis relative to the cranks, wherein the elongated member is further fixedly mounted to the left and right cranks at the respective ends, each at a further mounting point at the first portion of the respective crank, spaced from the first pivot point and further away from the second pivot point such that when the deflector mechanism is operated in the second position, the cranks are caused to move toward the front side of the buckle chute, forcing the extended section of the elongated member to move toward the entry point of the channel, and when the deflector mechanism is operated in the first position, the cranks are caused to move toward the back side of the buckle chute, forcing the extended section of the elongated member to move away from the entry point of the channel.

According to the present invention, the left and right cranks are linked to an actuating mechanism capable of causing the left and right cranks to move toward the back side of the buckle chute when the deflector mechanism is operated in the first position and to move toward the front side of the buckle chute when the deflector mechanism is operated in the second position.

According to the present invention, the actuating mechanism comprises:

a left arm, disposed near the left end of the buckle chute, for pivotably mounting the left crank at the second portion thereof, a right arm, disposed near the right end of the buckle chute, for pivotably mounting the right crank at the second portion thereof; and a linking mechanism mechanically engaged with the arms for simultaneously moving the arms for causing the cranks to move toward the front side or the back side of the buckle chute.

According to the present invention, the linking mechanism comprises:

a left linking member;

a right linking member;

a left bell crank movably linking the left linking member and the left arm;

a right bell crank movably linking the right linking member and the right arm; and a lever, separately mounting the left and right linking members for simultaneously rotating the left bell crank in a first direction and the right bell crank in a second direction opposite of the first direction so as to simultaneously move the left and right arms.

The present invention will become apparent upon reading the description taken in conjunction with FIGS. 1 to 12.

DETAILED DESCRIPTION

Figure 1:
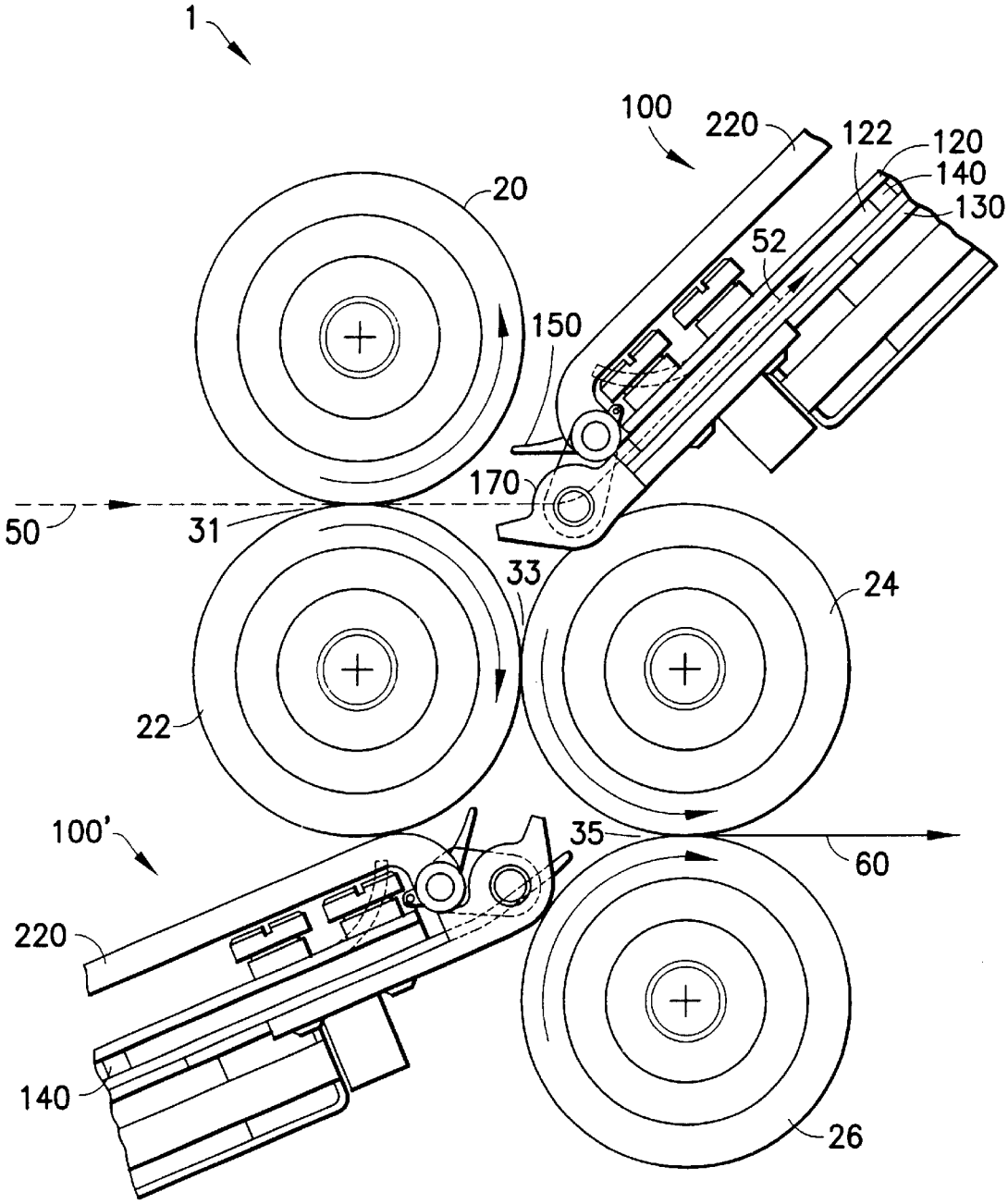
FIG. 1 is a diagrammatic representation illustrating a folding apparatus having two buckle chutes.

FIG. 1 is a schematic representation of a folding apparatus 1. As shown, the folding apparatus 1 has two buckle chutes 100, 100' positioned among three roller nips 31, 33 and 35. The roller nip 31 is formed by rollers 20 and 22, the roller nip 33 is formed by rollers 22 and 24, and the roller nip 35 is formed by rollers 24 and 26. The buckle chute 100 is positioned adjacent to the roller nips 31 and 33, and the buckle chute 100' is positioned adjacent to the roller nips 33 and 35. The number of buckle chutes determines how many folded edges a folding apparatus is capable of making on a sheet of document. However, the number of folded edges made on a sheet by the folding apparatus can be less than the number of buckle chutes in the folding apparatus. As shown in FIG. 1, the first buckle chute 100 and the second buckle chute 100' are similar, except that they are oriented differently. The buckle chute 100 has an upper guide 120 and a lower guide 130 forming therebetween a channel 122. A sheet 10 (FIGS. 2*a* and 2*b*) entering the folding apparatus 1 along an input path 50 is driven by the roller nip 31 toward the entry point 116 of the buckle chute 100. The sheet 10 is guided by the upper guide 120 and the lower guide 130 to enter the channel 122 along a direction 52. A stop 140 is provided in the channel 122 to prevent the sheet 10 from advancing further into the buckle chute 100. The folded piece 18 (FIG. 5*a*–5*b*) exits along an exit path 60. Stop 140 is preferably adjustable in the manner described in co-pending patent application Ser. No. _____, (Attorney Docket F-383) entitled ADJUSTABLE BUCKLE CHUTE FOLDING MACHINE, by David Auerbach and William Wright, filed concurrently with this application, and which is hereby incorporated by reference in its entirety.

Figure 2A:
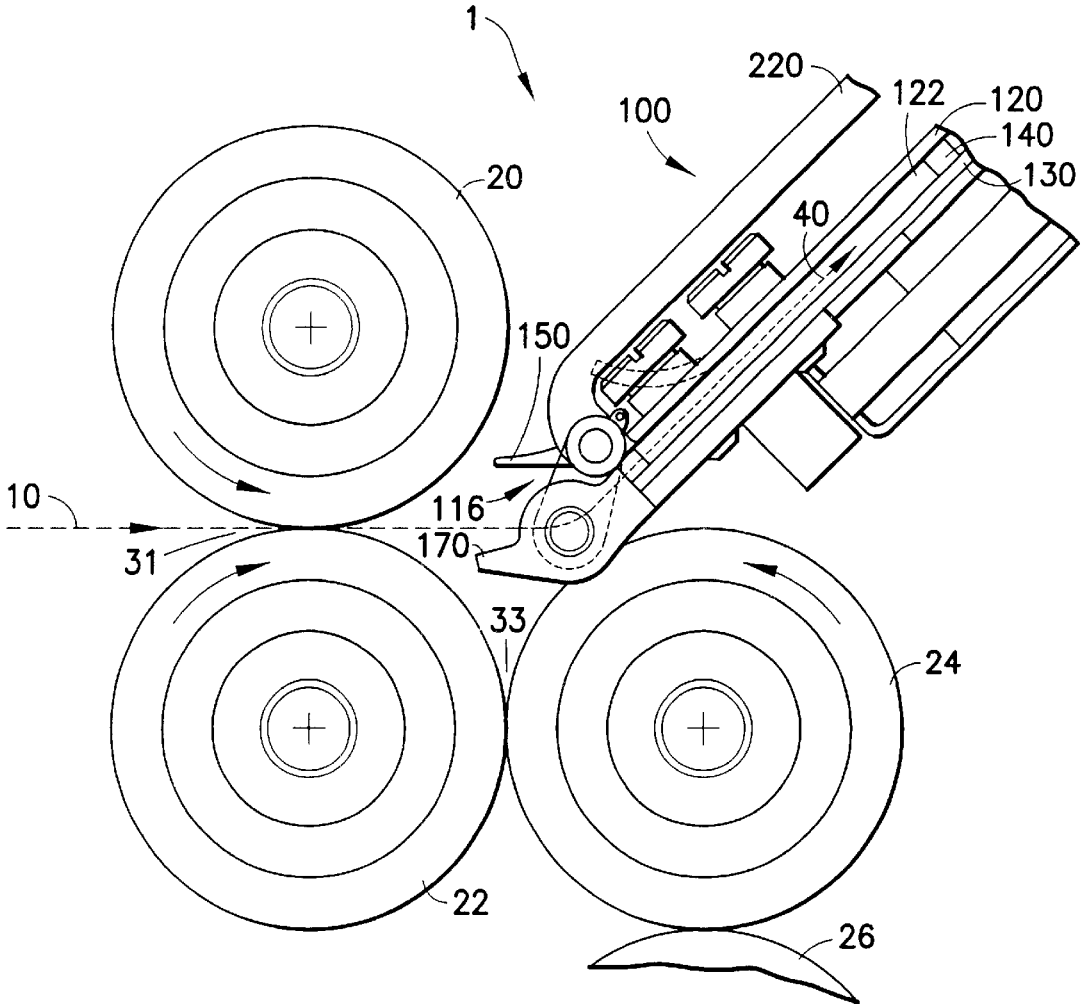
FIG. 2*a* is a diagrammatic representation illustrating the deflector on the buckle chute being opened to allow a sheet of document to enter into the channel of the buckle chute.
Figure 2B:
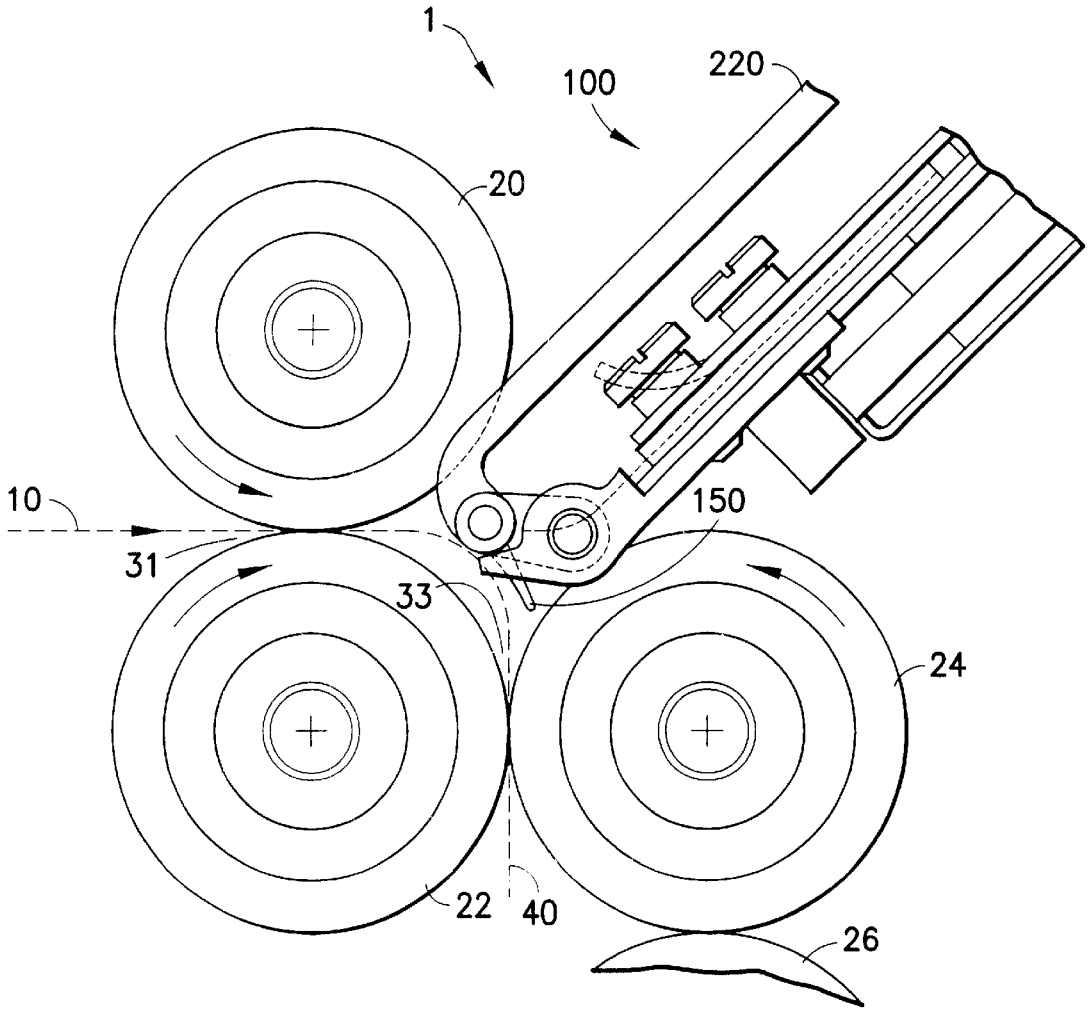
FIG. 2*b* is a diagrammatic representation illustrating the deflector being closed to deflect the sheet away from the buckle chute.

The buckle chute 100 has a deflector 150, located near the entry point 116 and mounted to a mounting system 170 for rotation. The deflector 150, controlled by an actuator arm 220, is operable either in an open position or in a closed position. As shown in FIG. 2*a,* the deflector 150 is operated in the open position to allow the leading edge 40 of the sheet 10 to enter into the channel 122 of the buckle chute 100. Preferably deflector 150 acts to guide the paper into the buckle chute 100 with the surface of deflector 150 opposite of the surface used to deflect sheet 10 from entering buckle chute 100. As shown in FIG. 2*b,* the deflector 150 is operated in the closed position, preventing the sheet 10 from entering the buckle chute 100. As such, the leading edge 40 of the sheet 10 is deflected toward the roller nip 33. The sheet 10 is further driven by the roller nip 33 toward the buckle chute 100' (FIG. 1).

Figure 3A:
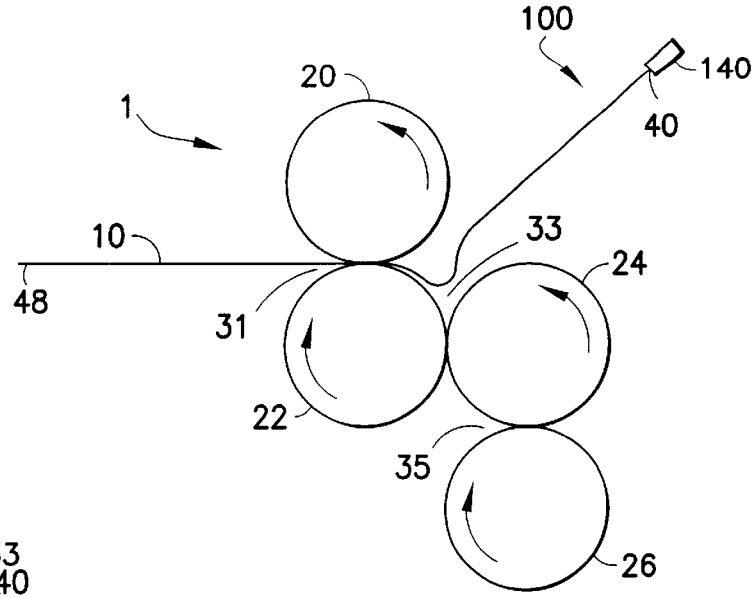
FIG. 3*a* is a diagrammatic representation illustrating a buckled portion being formed on a sheet of document.
Figure 3B:
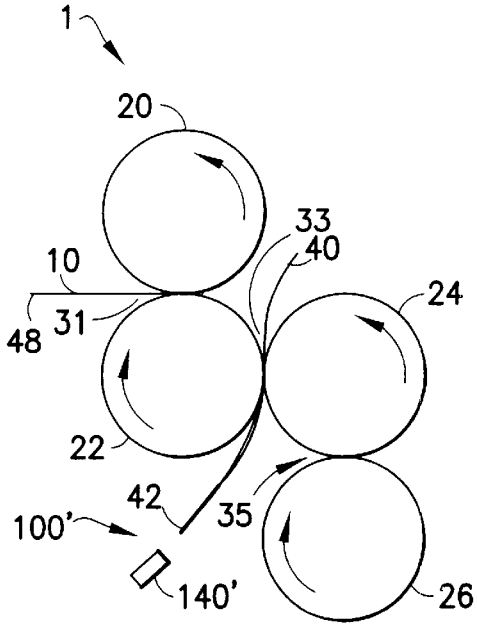
FIG. 3*b* is a diagrammatic representation illustrating the buckled portion being folded into a folded edge.
Figure 3C:
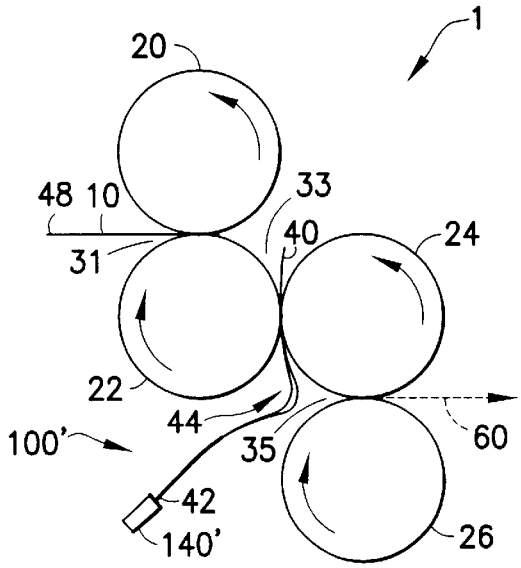
FIG. 3*c* is a diagrammatic representation illustrating a second buckled portion being formed on the folded sheet.
Figure 5A:
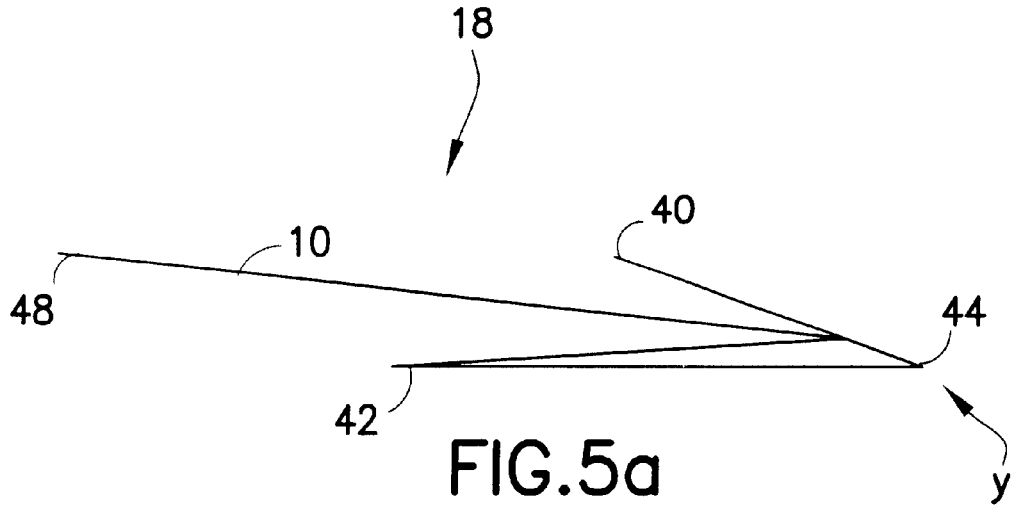
FIG. 5*a* is a diagrammatic representation illustrating a folded piece resulted from the folding arrangement, as shown in FIGS. 3*a*–3*c*.

FIGS. 3*a*–3*c* show how the sheet 10 is folded into a folded piece 18 (FIG. 5*a*). As shown in FIG. 3*a,* the deflector 150 of the buckle chute 100 is operated in the open position, allowing the leading edge 40 of the sheet 10 to reach the stop 140. As the rollers 20 and 22 keep driving the sheet 10 toward the buckle chute 100, they cause a portion of the sheet to buckle. The buckled portion is further moved toward the nip 33 and drawn into the nip 33. A folded edge 42 is thus formed by the nip 33, as shown in FIG. 3*b*. FIG. 3*c* illustrates the folded edge 42 entering into the buckle chute 100' and being stopped by the stop 140' of the buckle chute 100' for making a second folded edge 44 by the nip 35. After the sheet 10 exits the nip 35 along the exit path 60, it becomes a folded piece 18, as shown in FIG. 5*a*. Reference numeral 48 denotes the trailing edge of the sheet 10. The distance between the leading edge 40 and the folded edge 42 is determined by the distance between the stop 140 in the buckle chute 100 and the entry point 116, but it is also determined by the distance from the entry point 116 to the nip 33.

Figure 4A:
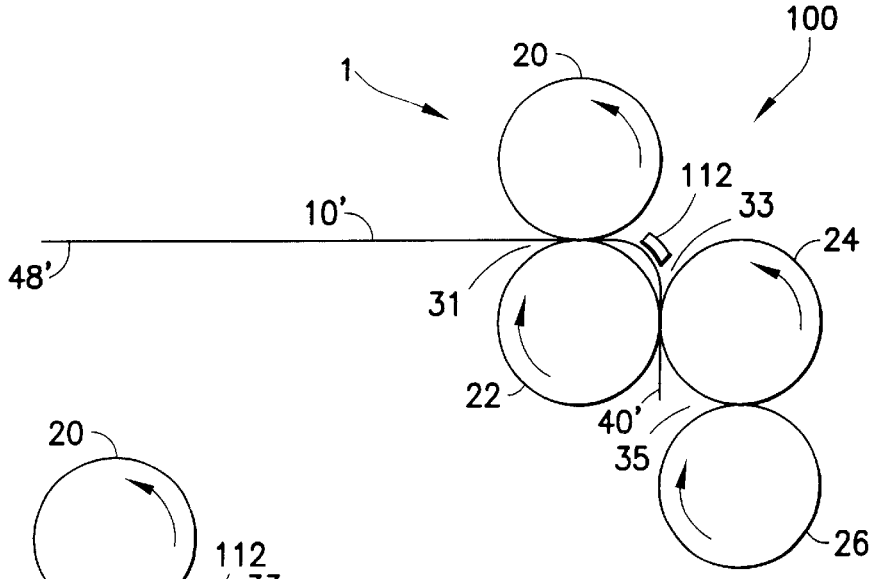
FIG. 4*a* is a diagrammatic representation illustrating the leading edge of a sheet being deflected away from the first buckle chute.
Figure 4B:
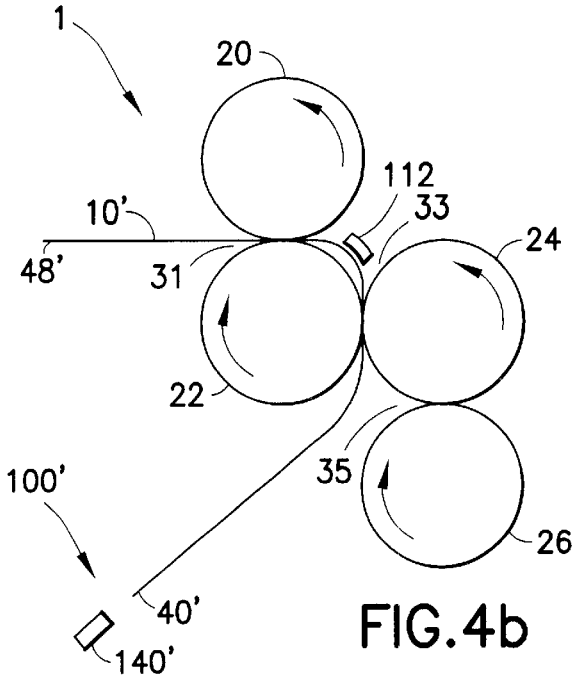
FIG. 4*b* is a diagrammatic representation illustrating the leading edge of the sheet entering the second buckle chute.
Figure 4C:
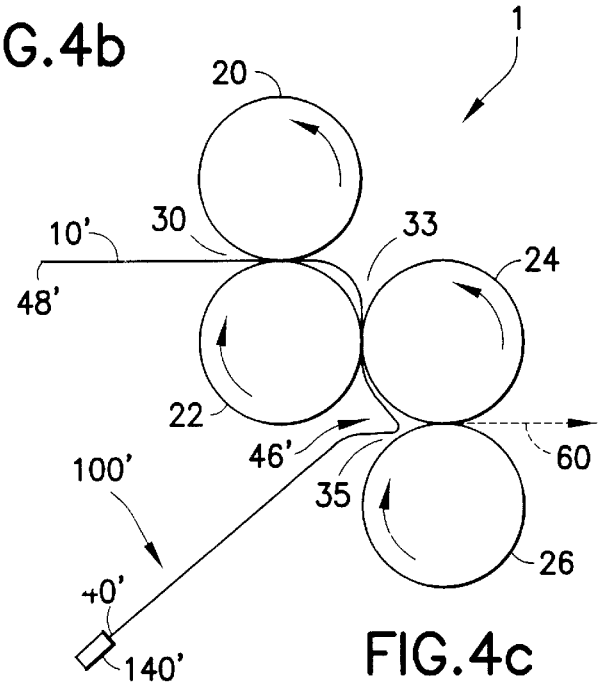
FIG. 4*c* is a diagrammatic representation illustrating a buckled portion of the sheet being formed.
Figure 5B:
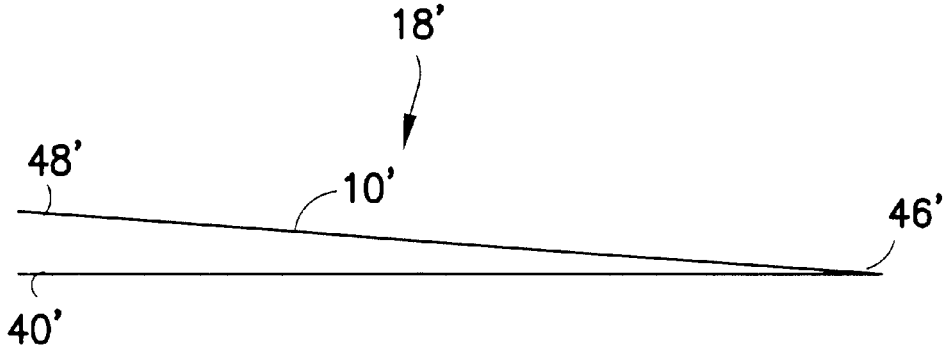
FIG. 5*b* is a diagrammatic representation illustrating a folded piece resulted from the folding arrangement, as shown in FIGS. 4*a*–4*c*.

If the deflector 150 of the buckle chute 100 is operated in the closed position, a sheet 10' driven into the folding apparatus 1 by the nip 31 is deflected by the deflector 150, as shown in FIG. 4*a*. The leading edge 40' of the sheet 10' is drawn into the nip 33 and moved into the buckle chute 100', as shown in FIG. 4*b*. While the leading edge 40' of the sheet 10' is stopped by the stop 140' of the buckle chute 100', the rollers 20, 22 and 24 keep advancing the sheet 10' into the folding apparatus 1. As a result, the sheet 10' is buckled and the buckled portion is moved toward the nip 35 for making a folded edge 46'. After the sheet 10' exits the nip 35 along the exit path 60, it becomes a folded piece 18', as shown in FIG. 5*b*.

Figure 6A:
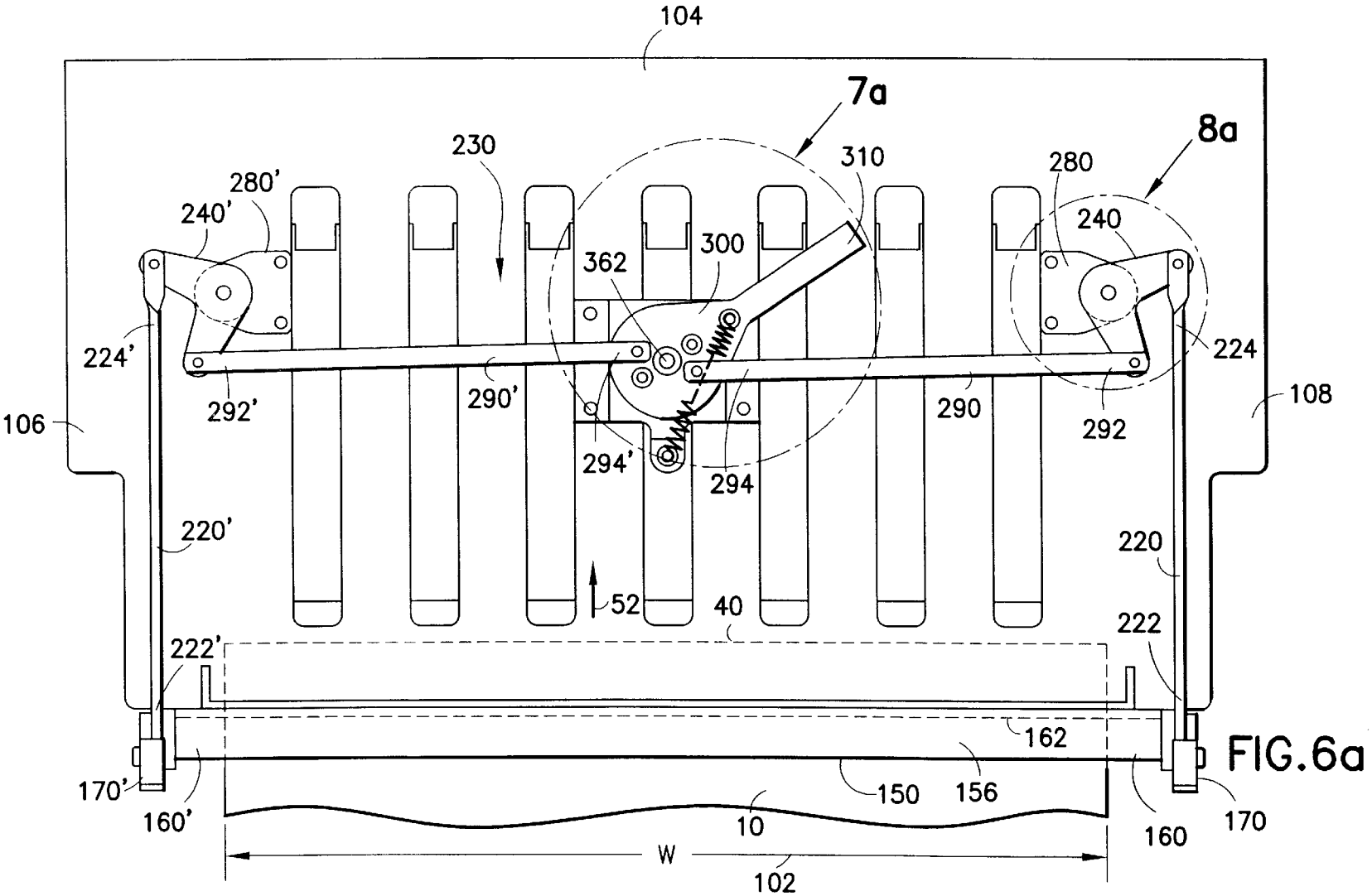
FIG. 6*a* is a top view of the buckle chute showing the deflector mechanism operated in an open position.
Figure 6B:
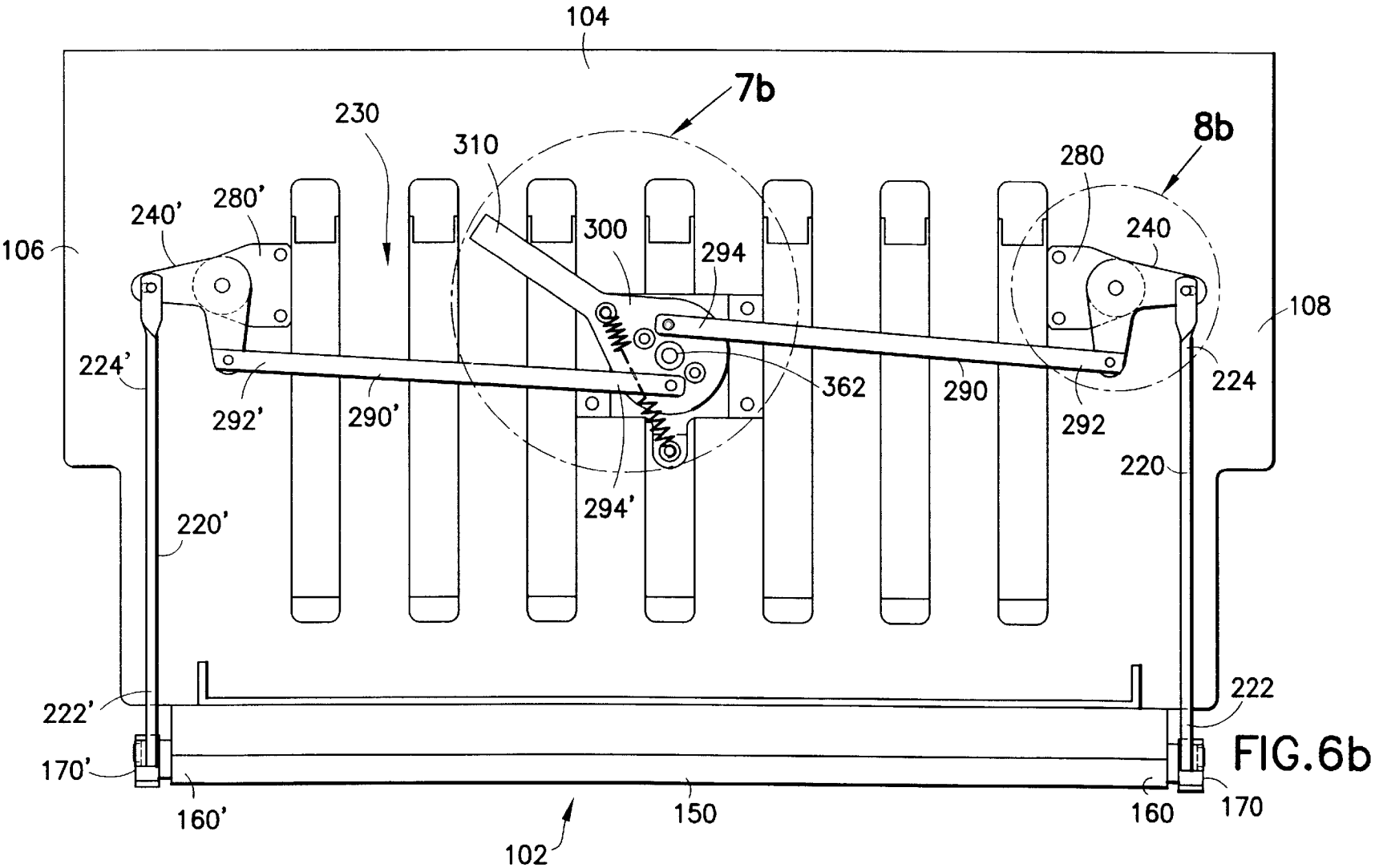
FIG. 6*b* is a top view of the buckle chute showing the deflector mechanism operated in a closed position.

FIGS. 6*a* and 6*b* are top views of the buckle chute 100 showing an actuating mechanism being used to control the deflector 150. The buckle chute 100 has a front side 102, a back side 104, a left side 106 and a right side 108. The actuating mechanism comprises a right actuating arm 220 adjacent to the right side 108 and a left actuating arm 220' adjacent to the left side 106, and a linking mechanism 230. Each actuating arm 220, 220' has a front arm section 222, 222' linked to the deflector 150 and a rear arm section 224, 224' linked to the linking mechanism 230. The deflector 150 is an elongated member having a right end 160 and a left end 160' adjacent to the respective sides 106, 108 of the buckle chute 100. Each end 160, 160' has a mounting section 152, 152' with a first mounting point 154, 154' (see FIG. 10). The first mounting point 154 in the right end 160 and the first mounting point 154' in the left end 160' define a rotational axis 162 of the deflector 150. The elongated member of the deflector 150 further has an extended portion 156 extended from the rotational axis 162 between the right end 160 and the left end 160' (see FIG. 10). The actuating arms 220, 220' and the deflector 150 are mechanically connected to the mounting systems 170, 170' to control the deflector 150 (see FIGS. 9*a* and 9*b*).

The linking mechanism 230 comprises a left bell crank 240' for pivotally linking to the rear arm section 224' of the left actuating arm 220' and a right bell crank 240 for pivotally linking to the rear arm section 224 of the right actuating arm 220. The bell cranks 240, 240' are linked to a lever plate 300 via linking members 290 and 290'. The bell cranks 240, 240' are pivotally mounted to a mounting plate 280, 280', which is fixedly mounted to the buckle chute 100. The lever plate 300 is pivotally mounted at a pivot point 362. The lever plate 300 has a lever 310 to actuate the deflector 150.

As shown in FIGS. 6*a* and 6*b,* each of the linking members 290, 290' has a first linking end 292, 292' for pivotally connecting to the respective bell crank 240, 240', and a second linking end 294, 294' for pivotally connecting to the lever plate 300. When the lever 310 is moved to the right position, as shown in FIG. 6*a,* the actuator arms 220, 220' are caused to move toward the back end 104 of the buckle chute 100, forcing the deflector 150 to rotate in a clockwise direction about the rotational axis 162 and moving the extended portion 156 upward, relative to the first mounting points 154', 154 (see FIG. 9*a*). As such, the deflector 150 is set to the open position to allow a sheet 10, 10' to enter the channel 122 of the buckle chute 100. When the lever 310 is moved to the left position, as shown in FIG. 6*b,* the actuator arms 220, 220' are caused to move toward the front end 102 of the buckle chute 100, forcing the deflector 150 to rotate in a counter-clockwise direction about the rotational axis 162 and moving the extended portion 156 downward, relative to the first mounting points 154, 154' (see FIG. 9*b*). As such, the deflector 150 is set to the closed position to deflect a sheet 10, 10' away from the buckle chute 100.

Figure 7A:
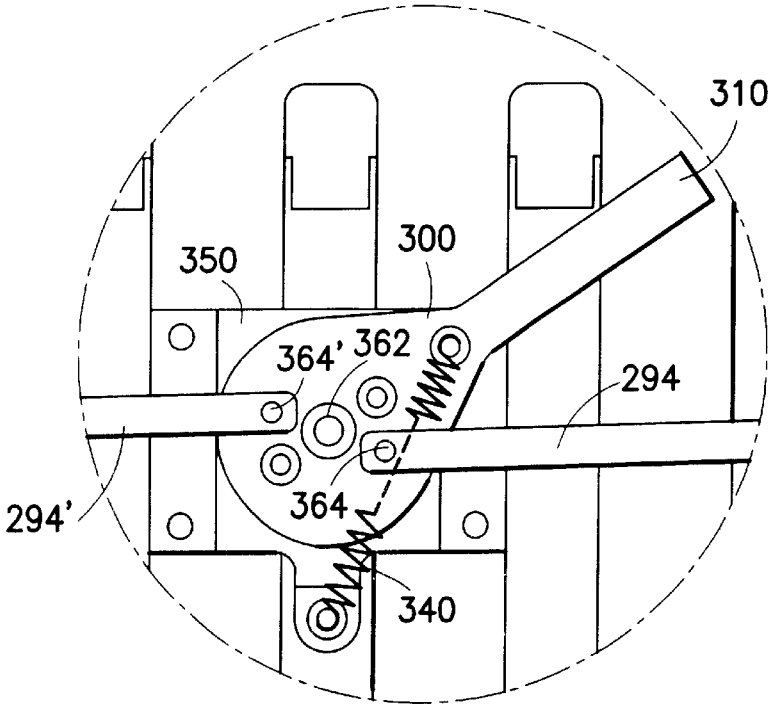
FIG. 7*a* is a top view showing a lever plate linking to the deflector mechanism being operated in a first position.
Figure 7B:
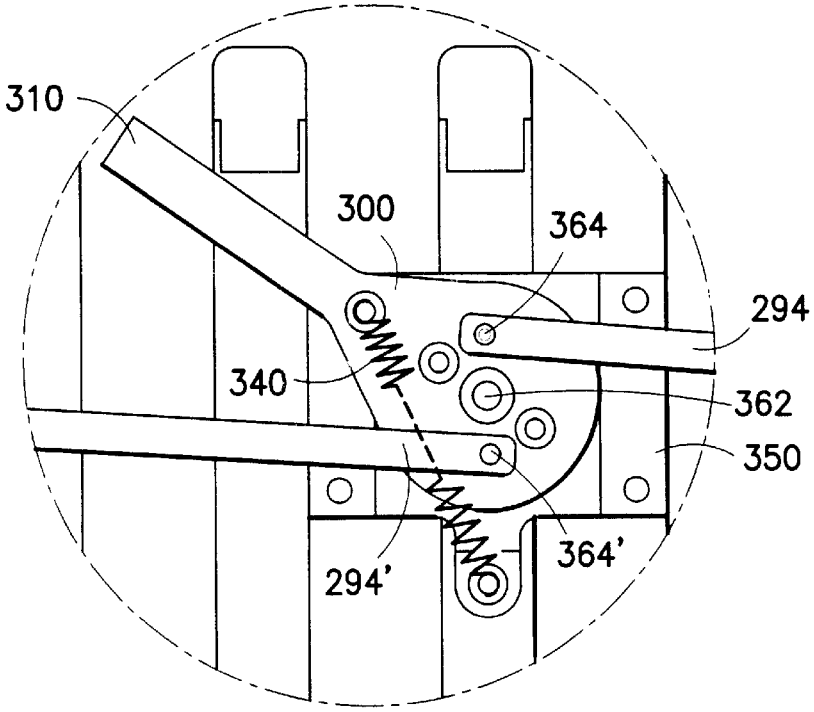
FIG. 7*b* is a top view showing the lever plate being operated in a second position.

As shown in FIGS. 7*a* and 7*b,* the lever plate 300 is pivotally mounted at the pivot 362 to a mounting plate 350, which is fixedly mounted to buckle chute 100. The second end 294 of the right linking member 290 is pivotally mounted to the right side of the lever plate 300 at a pivot point 364 between the pivot 362 and the lever 310. The second end 294' of the left linking member 290' is pivotally mounted to the left side of the lever plate 300 at a pivot point 364' adjacent to the pivot 362 further away from the lever 310. Thus, when the lever 310 is moved to the right position, as shown in FIG. 7*a,* the right linking arm 290 is caused to move toward the right side 108 and the left linking arm 290' is caused to move toward the left side 106 of the buckle chute 100.

Figure 8A:
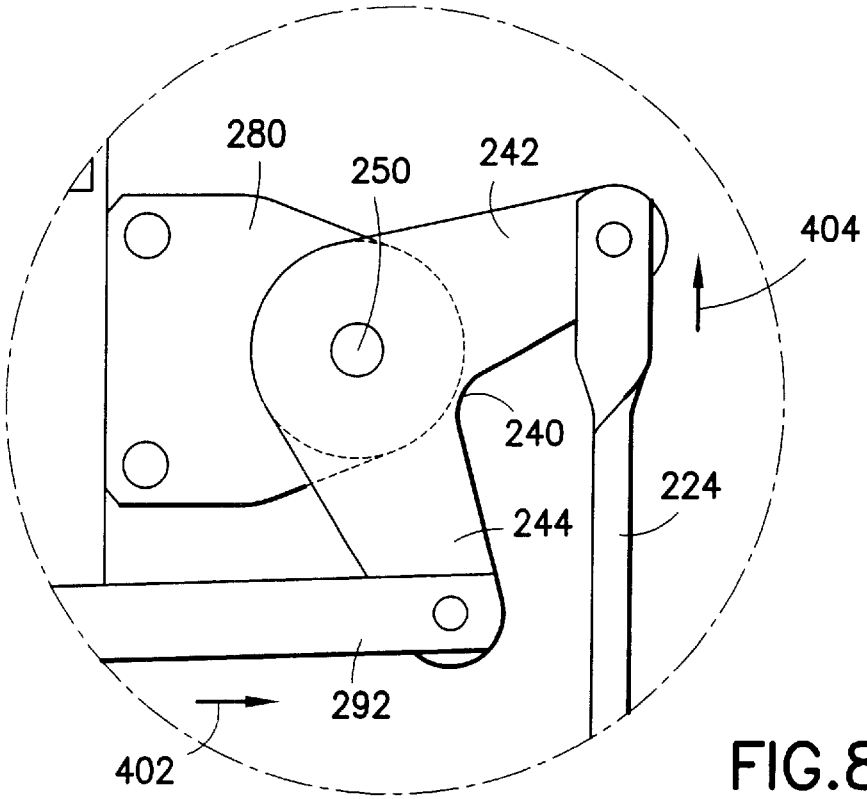
FIG. 8*a* is a top view showing a bell crank linking to the deflector mechanism being operated in the first position.
Figure 8B:
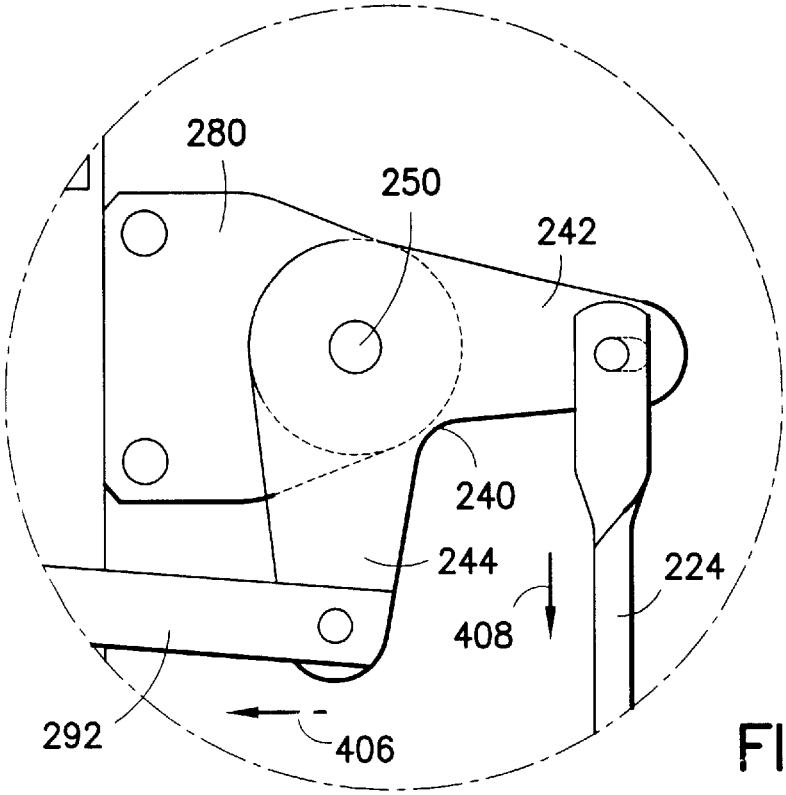
FIG. 8*b* is a top view showing the bell crank being operated in the second position.

As shown in FIGS. 8*a* and 8*b,* the right bell crank 240 is pivotally mounted at a pivot 250 to the fixed mounting plate 280 for rotation. In particular, the right bell crank 240 has a front section 244 pivotally linked to the first linking end 292 of the linking member 290, and a rear section 242 pivotally linked to the rear arm section 224 of the right actuating arm 220. When the right linking member 290 is caused to move toward the right side 108 of the buckle chute 100, as indicated by arrow 402 in FIG. 8*a,* the right linking member 292 causes the right bell crank 240 to rotate in a counter-clockwise direction, forcing the actuating arm 220 to move toward the back side 104 of the buckle chute 100, as indicated by arrow 404. When the right linking member 290 is caused to move toward the left side 106 of the buckle chute 100, as indicated by arrow 406 in FIG. 8*b,* the right linking member 290 causes the right bell crank 240 to rotate in a clockwise direction, forcing the actuating arm 220 to move away from the back side 104 of the buckle chute 100, as indicated by arrow 408. Similarly, the left linking member 290' causes the left actuating arms to move toward or away from the back side 104 when the left linking member 290' is caused to move toward or away from the left side 106 of the buckle chute 100.

Figure 9A:
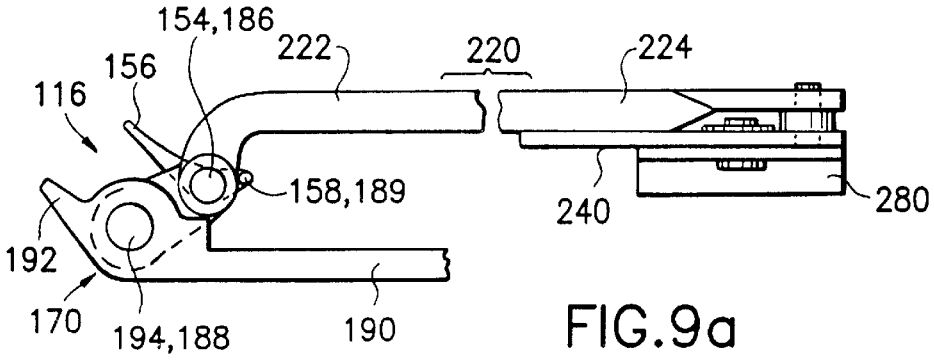
FIG. 9*a* is a side view showing the position of the actuator arm and the crank relative to the mounting member when the deflector mechanism is operated in the open position.
Figure 9B:
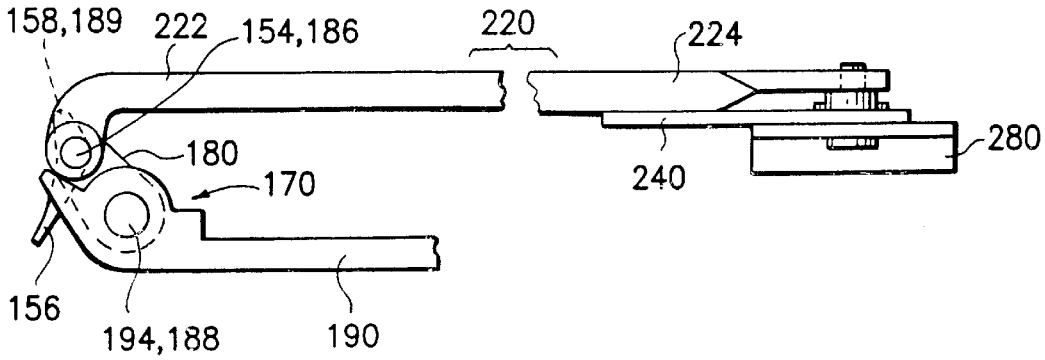
FIG. 9*b* is a side view showing the position of the actuator arm and the crank relative to the mounting member when the deflector mechanism is operated in the closed position.
Figure 10:
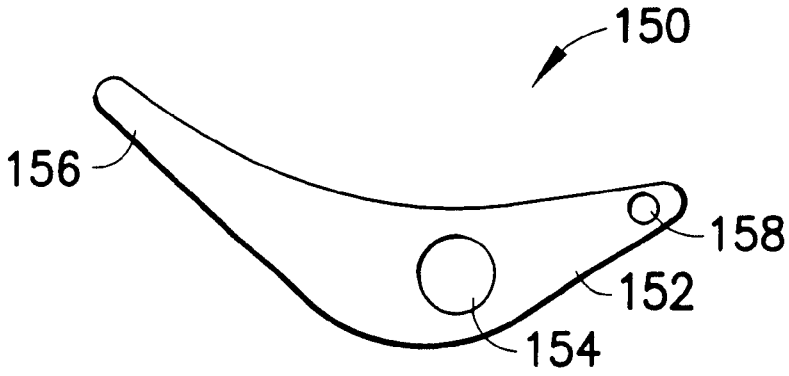
FIG. 10 is a side view showing the mounting section of the deflector mechanism.
Figure 11:
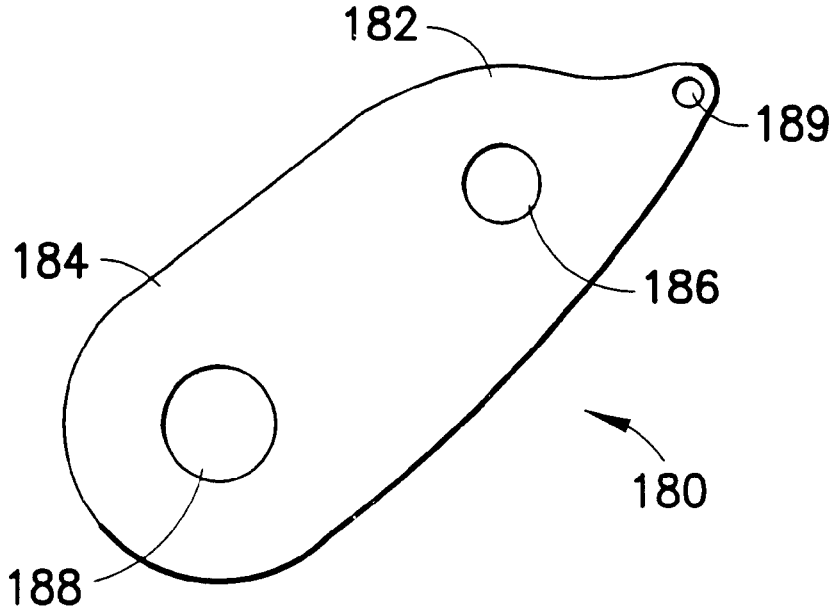
FIG. 11 is an isometric view showing a crank for mounting the mounting section of the deflector mechanism.

FIGS. 9*a* and 9*b* show the mounting system 170 for mounting the deflector 150 and the actuating arm 220. The mounting system 170 comprises a crank 180 and a mounting member 190. The crank 180 has an upper portion 182 having a first pivot point 186, and a lower portion 184 having a second pivot point 188 (see FIG. 11). The mounting member 190, which is fixedly mounted to the buckle chute 100 under the lower guide 130 (FIGS. 1–2*b*), has a front end 192 for pivotally mounting the crank 180 at the second pivot point 188 so as to allow the upper portion 182 of the crank 180 to move back and forth, relatively to the second pivot point 188. The upper portion 182 of the crank 180 is used to pivotally mount, at the first pivot point 186, the front arm portion 222 of the actuating arm 220 together with the mounting section 152 of the deflector 150 at the first mounting point 154 so as to allow the deflector 150 to rotate about the rotational axis 162 (see FIG. 6*a*). The mounting section 152 of the deflector 150 is also fixedly mounted at a second mounting point 158 (FIG. 10) to the upper portion 182 of the crank 180 at a point 189 adjacent to the first pivot point 186, further away from the second pivot point 188. Because of the relationship between the fixed mounting point 158 and the pivotally mounting point 154, the deflector 150 is caused to rotate when the crank 180 is caused to move back and forth by the actuating arm 220. As shown in FIG. 9*a,* the crank 180 is caused to move away from the front end 102 of the buckle chute 100, causing the extended portion 156 of the deflector 150 to rotate in a clockwise direction about the rotational axis 162 to unblock the entry point 116 of the channel 122 of the buckle chute 100 (FIGS. 1 and 2*a*). As shown in FIG. 9*b,* the crank 180 is caused to move toward the front end 102 of the buckle chute 100, causing the extended portion 156 of the deflector 150 to rotate in a counter-clockwise direction about the rotational axis 162 to block off the channel 122 of the buckle chute 100 (FIG. 2*b*).

Figure 12:
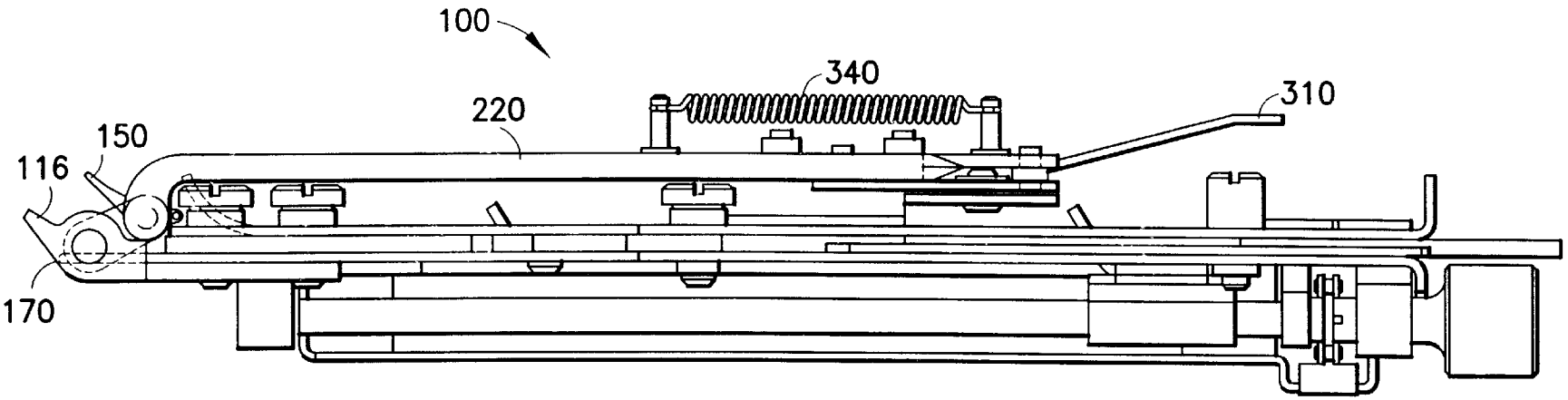
FIG. 12 is a side view showing the buckle chute, according to the present invention.

As the lever plate 300 is mounted near the back side 104 of the buckle chute 100, the lever 310 is located far away from the rollers 20, 22, 24 and 26. It may not be necessary to remove the buckle chute 100 from the folding apparatus 1 in order to change the position of the lever 310. Furthermore, a spring 340 is disposed between the mounting plate 350 and the lever plate 300 near the lever 310 to prevent the lever 310 from accidentally changing positions, as shown in FIG. 12.

It should be noted that the bell crank 240, as shown in FIGS. 6*a* and 8*b,* is caused to rotate in a clockwise direction when the linking member 290 is moved away from the right side 108 of the buckle chute 100, thereby moving the actuator arm 220 toward the front side 102 of the buckle chute. It is possible to mount the linking member 290 and actuator arm 220 on a similar bell crank in a different way such that the actuator arm 220 is moved away from the front side 102 when the bell crank is caused to rotate in the clockwise direction by the rightward movement of the linking member 290. Furthermore, the linking member 290 is caused to move away from the right side 108 when the lever 310 is moved to right position, as shown in FIGS. 6*a* and 7*a*. It is also possible to mount the linking member 290 to a different location on the lever plate 300 such that the linking member 290 is caused to move toward the right side 108 when the lever 310 is moved to the right position.

Although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A buckle chute having a front side, a back side, a left side and a right side for use in a folding apparatus having a first driving mechanism and a second driving mechanism for folding at least one sheet of caper having first and second lateral edges defining a width into a folded piece of the same width, the first and the second lateral edges adjacent to the left and right sides of the buckle chute, said buckle chute disposed between the first driving mechanism and the second driving mechanism, said buckle chute comprising:

an upper guide and a lower guide for forming a channel having an entry point on the front side of the buckle chute adjacent the first driving mechanism;

a deflector mechanism, disposed near the entry point of the channel and operable in a first position for allowing a leading edge of said at least one sheet or the folded piece to enter to the channel while said at least one sheet or the folded piece is driven by the first driving mechanism toward the entry point of the buckle chute, or in a second position for preventing the leading edge of said at least one sheet or the folded piece from entering the channel and further directing the leading edge toward the second driving mechanism; and a stop, disposed in the channel between the front side and the back side, for stopping the leading edge of said at least one sheet or the folded piece entering the channel, when the deflector mechanism is operated in the first position, from advancing further into the channel toward the back side so as to cause said at least one sheet or the folded piece to buckle at a locality thereof outside the entry point of the channel toward the second driving mechanism for forming a folded edge at the buckled locality by the second driving mechanism as the first driving mechanism continues driving said at least one sheet or the folded piece toward the buckle chute, wherein the deflector mechanism comprises:

an elongated member having a left end an right end adjacent to the respective sides of the buckle chute, the left end and the right end each having a mounting section with a mounting point defining a rotational axis of the elongated member, and an extended section extended between the left end and the right end from the mounting section of each end and along the longitudinal axis, and a mounting system, disposed near the entry point of the channel for pivotably mounting the elongated member at the mounting point at each end of the elongated member, allowing the elongated member to rotate about the rotational axis relative to the mounting system such that when the deflector mechanism is operated in the second position, the extended section of the elongated member is caused to move toward the entry point of the channel, thereby blocking the entry point, and when the deflector mechanism is operated in the first position, the extended section of the elongated member is caused to move away from the entry point of the channel, thereby unblocking the entry point; and wherein the buckle chute mounting system comprises:

a left crank and a right crank, each disposed near the respective side of the buckle chute, each crank having a first portion with a first pivot point and a second portion with a second pivot point spaced from the first pivot point; and a left mounting member and a right mounting member, each fixedly disposed near the respective side of the buckle chute adjacent to the entry point, for pivotably mounting the respective crank at the second pivot point thereof, allowing the first portion to move toward the front side or the back side of the buckle chute relative to the respective mounting member, and each end of the elongated member is pivotably mounted to the respective crank at the first pivot point such that the elongated member can be caused to rotate about the rotational axis relative to the cranks, wherein the elongated member is further fixedly mounted to the left and right cranks at the respective ends, each at a further mounting point at the first portion of the respective crank spaced from the first pivot point and further away from the second pivot point such that when the deflector mechanism is operated in the second position, the cranks are caused to move toward the front side of the buckle chute, forcing the extended section of the elongated member to move toward the entry point of the channel, and when the deflector mechanism is operated in the first position, the cranks are caused to move toward the back side of the buckle chute, forcing the extended section of the elongated member to move away from the entry point of the channel.

2. The buckle chute of claim 1, wherein the left and right cranks are linked to an actuating mechanism capable of causing the left and right cranks to move toward the back side of the buckle chute when the deflector mechanism is operated in the first position and to move toward the front side of the buckle chute when the deflector mechanism is operated in the second position.

3. The buckle chute of claim 2, wherein the actuating mechanism comprises:

a left arm, disposed near the left side of the buckle chute, for pivotably mounting the left crank at the second portion thereof, a right arm, disposed near the right side of the buckle chute, for pivotably mounting the right crank at the second portion thereof; and a linking mechanism mechanically engaged with the arms for simultaneously moving the arms for causing the cranks to move toward the front side or the back side of the buckle chute.

4. The buckle chute of claim 3, wherein the linking mechanism comprises:

a first linking member;

a second linking member;

a first bell crank movably linking the first linking member to the right arm;

a second bell crank movably linking the second linking member to the left arm; and a lever, separately mounting the first and second linking members for simultaneously rotating the first bell crank in a first direction and the second bell crank in a second direction opposite of the first direction so as to simultaneously move the arms.

5. The buckle chute of claim 4, wherein the lever is operable in a first lever position to cause the deflector mechanism to operate in the first position, or a second lever position to cause the deflector mechanism to operate in the second position, and wherein when the lever is operated in the first lever position, the lever causes the first linking member to move toward the right side of the buckle chute, the second linking member to move toward the left side of the buckle chute, the first bell crank to rotate in a counter-clockwise direction, the second bell crank to rotate in a clockwise direction, and both the right arm and the left arm to move toward the back side of the buckle chute, thereby causing the left and right cranks to move simultaneously toward the back side of the buckle chute, and when the lever is operated in the second lever position, the lever causes the first linking member to move toward the left side of the buckle chute, the second linking member to move toward the right side of the buckle chute, the first bell crank to rotate in a clockwise direction, the second bell crank to rotate in a counter-clockwise direction, and both the right arm and the left arm to move toward the front side of the buckle chute, thereby causing the left and right cranks to move simultaneously toward the front side of the buckle chute.

* * * * *